US007789638B2

(12) United States Patent
Chuang

(10) Patent No.: US 7,789,638 B2
(45) Date of Patent: Sep. 7, 2010

(54) PUMP FOR PROVIDING THREE MODES OF PUMPING

(76) Inventor: Louis Chuang, 8th Floor-4, No. 20, Ta Lon Road, Taichung (TW)

( * ) Notice: Subject to any disclaimer, the term of this patent is extended or adjusted under 35 U.S.C. 154(b) by 936 days.

(21) Appl. No.: 11/383,098

(22) Filed: May 12, 2006

(65) Prior Publication Data

US 2007/0264143 A1 Nov. 15, 2007

(51) Int. Cl.
*F04B 23/04* (2006.01)
*F04B 23/00* (2006.01)
*F01B 1/00* (2006.01)

(52) U.S. Cl. ..... 417/429; 417/440; 417/521; 92/146

(58) Field of Classification Search ..... 417/559, 417/426–429, 440, 521, 531, 569, 528–529, 417/523, 533, 486, 254, 435, 446, 447; 92/146, 92/23, 223, 224, 493.8, 181 R, 181 P; 91/422
See application file for complete search history.

(56) References Cited

U.S. PATENT DOCUMENTS

| | | | | | |
|---|---|---|---|---|---|
| 90,718 | A | * | 6/1869 | Appel | 417/529 |
| 817,538 | A | * | 4/1906 | Wixon | 417/258 |
| 1,275,440 | A | * | 8/1918 | Johnson | 417/521 |
| 1,332,293 | A | * | 3/1920 | Hanger | 417/526 |
| 1,341,460 | A | * | 5/1920 | Griesbaum | 92/161 |
| 1,349,218 | A | * | 8/1920 | Moon | 92/146 |
| 1,357,402 | A | * | 11/1920 | Kellogg | 417/254 |
| 1,390,559 | A | * | 9/1921 | Huntley | 92/146 |
| 1,392,928 | A | * | 10/1921 | Foss | 417/533 |
| 1,414,621 | A | * | 5/1922 | Burnam | 417/528 |
| 1,472,947 | A | * | 11/1923 | Tharp | 417/511 |
| 1,476,858 | A | * | 12/1923 | Vandeberg | 417/254 |
| 1,484,549 | A | * | 2/1924 | Burnam | 417/528 |
| 1,527,226 | A | * | 2/1925 | Rollins | 92/23 |
| 1,906,405 | A | * | 5/1933 | Patrick | 417/487 |
| 2,383,181 | A | * | 8/1945 | Enslin et al. | 137/565.31 |
| 2,476,481 | A | * | 7/1949 | Cunniff | 417/486 |
| 3,612,722 | A | * | 10/1971 | Neward | 417/63 |
| 4,334,839 | A | * | 6/1982 | Flagg | 417/536 |
| 4,508,490 | A | * | 4/1985 | Ramirez et al. | 417/234 |

(Continued)

OTHER PUBLICATIONS

Taiwanese Patent Publication No. 524274, Mar. 11, 2003, 6 pages.

*Primary Examiner*—Charles G Freay
*Assistant Examiner*—Alexander B Comley
(74) *Attorney, Agent, or Firm*—Alan Kamrath; Kamrath & Associates PA

(57) ABSTRACT

A pump includes a base and a cylinder installed on the base. The base defines a pumping channel. The cylinder defines a first chamber and a second chamber with a diameter different from that of the first chamber. The first and second chambers are in communication with the pumping channel. A first check valve only allows air to travel into the pumping channel from the first chamber. A second check valve allows air to travel into the pumping channel from the second chamber. A first piston is movable in the first chamber. A second piston is movable in the second chamber. A control device prevents the venting of air from the chambers in a first mode, vents air from the second chamber without traveling through the pumping channel in a second mode, and vents air from the first chamber without traveling through the pumping channel in a third mode.

14 Claims, 19 Drawing Sheets

4-4

U.S. PATENT DOCUMENTS 4,708,603 A * 11/1987 Kubo ..... 417/415
5,435,703 A * 7/1995 Lin ..... 417/428
5,533,436 A * 7/1996 Chuang ..... 92/146
5,533,879 A * 7/1996 Chen ..... 417/553
5,676,529 A * 10/1997 Hermansen et al. ..... 417/259
5,779,457 A * 7/1998 Chuang et al. ..... 417/467
5,873,705 A * 2/1999 Chen ..... 417/259
6,027,319 A * 2/2000 Winefordner et al. ..... 417/440
6,050,791 A * 4/2000 Wu ..... 417/521
6,190,142 B1 * 2/2001 Wu ..... 417/523
6,257,849 B1 * 7/2001 Wu ..... 417/469
6,299,420 B1 * 10/2001 Saputo et al. ..... 417/527
6,318,969 B1 * 11/2001 Wang ..... 417/63
6,325,601 B2 * 12/2001 Wu ..... 417/469
6,371,741 B1 * 4/2002 Wu ..... 417/446
6,422,832 B1 * 7/2002 Wang ..... 417/315
6,428,290 B1 * 8/2002 Wang ..... 417/468
6,652,242 B2 * 11/2003 Wu ..... 417/63
6,676,390 B2 * 1/2004 Wang ..... 417/528
6,814,552 B2 * 11/2004 Wu ..... 417/440
6,953,326 B2 * 10/2005 Wang ..... 417/234
2003/0156960 A1 * 8/2003 Wang ..... 417/528
2003/0221724 A1 * 12/2003 Wang ..... 137/223

* cited by examiner 4-4

12-12

13-13

PUMP FOR PROVIDING THREE MODES OF PUMPING

BACKGROUND OF INVENTION

1. Field of Invention

The present invention relates to a pump and, more particularly, a pump for providing three modes of pumping.

2. Related Prior Art

Cycling is a popular sport. Some people ride mountain bicycles in mountain areas. Some other people ride racing bicycles around tracks. Although not common, some other people ride general-purpose bicycles for everyday short-range transportation in cities. The bicycle includes various tires. The tires all must be pumped but require different standards of pressure. Some of the bicycles are each equipped with one or two cushions. To pump the various tires and cushions, there are devised various pumps. A shop or workshop is forced to buy various pumps for pumping various tires and cushions.

Disclosed in Taiwanese Patent Publication No. 524274 is a pump for pumping at a high pressure and at a high rate. The conventional pump includes a base 10, a first cylinder 30 installed on the base 10, a second cylinder 51 inserted in the first cylinder 30, a piston 53 attached to the second cylinder 51, a third cylinder 40 inserted in the second cylinder 51 through the piston 53, a piston 41 attached to the third cylinder 40 and a regulator 20 for accumulating air in the second cylinder 51.

Several problems have been encountered during the use of the conventional pump. Firstly, it provides only two pressures, and two pressures are not enough for various tires and cushions. An additional pump is required for pumping a tubular tire or a cushion. For a rider, it is inconvenient to carry a pump for tires and another pump for cushions.

Secondly, the assembly of the cylinders in a telescopic manner is complicated and, hence, expensive.

Thirdly, it is vulnerable to leaks, since the cylinders are assembled in the telescopic manner.

Fourthly, a user cannot hold it in position, since it fails to provide adequate treads for the user's feet.

The present invention is therefore intended to obviate or at least alleviate the problems encountered in the prior art.

SUMMARY OF INVENTION

According to the present invention, a pump includes a base and a cylinder installed on the base. The base defines a pumping channel. The cylinder defines a first chamber and a second chamber with a diameter different from that of the first chamber. The first and second chambers are in communication with the pumping channel. A first check valve only allows air to travel into the pumping channel from the first chamber. A second check valve allows air to travel into the pumping channel from the second chamber. A first piston is movable in the first chamber. A second piston is movable in the second chamber. A control device prevents the venting of air from the chambers in a first mode, vents air from the second chamber without traveling through the pumping channel in a second mode, and vents air from the first chamber without traveling through the pumping channel in a third mode.

An advantage of the pump of the present invention is the modes for pumping various tires and cushions.

Another advantage of the pump of the present invention is its easy and, hence, inexpensive assembly.

Still an advantage of the pump of the present invention is its air-tightness.

Other advantages and features of the present invention will become apparent from the following description referring to the drawings.

BRIEF DESCRIPTION OF DRAWINGS

The present invention will be described through detailed illustration of two embodiments referring to the drawings.

DETAILED DESCRIPTION OF EMBODIMENTS

Figure 1:
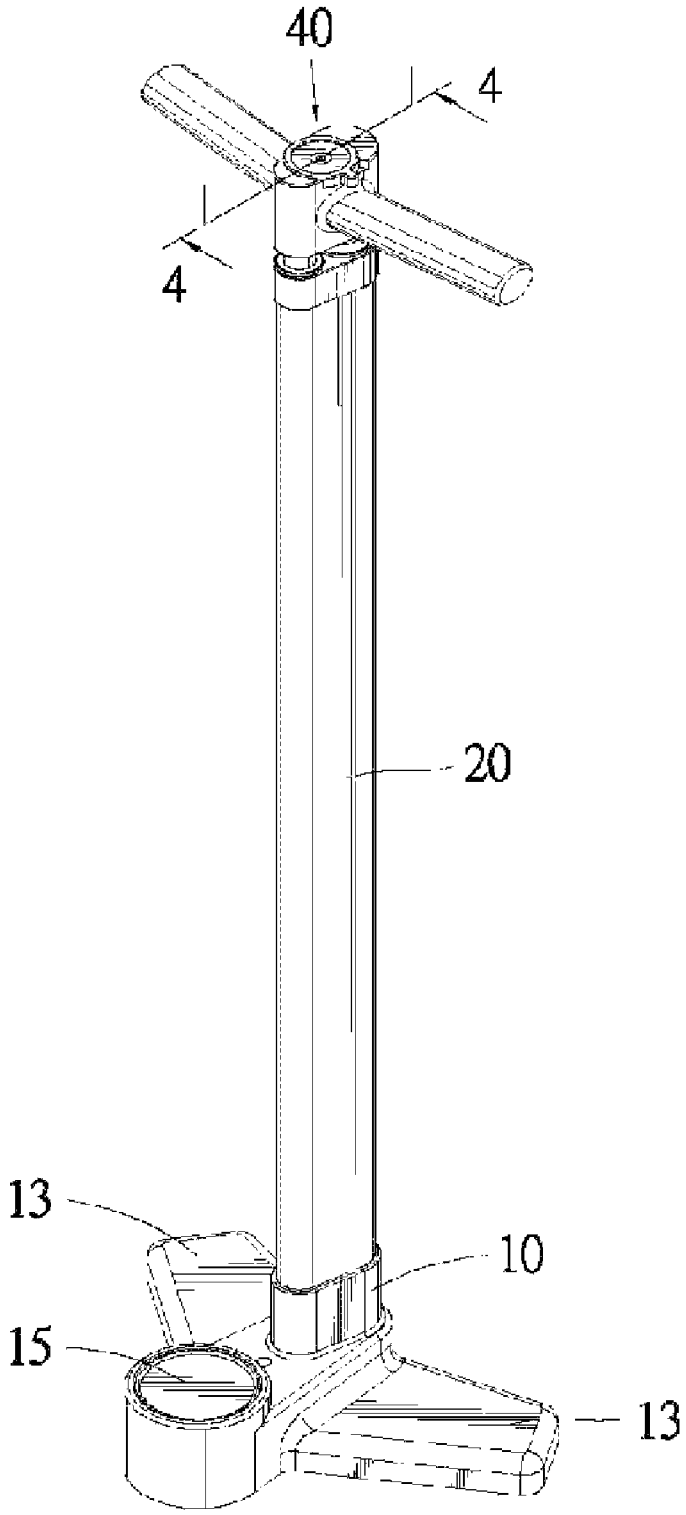
FIG. 1 is a perspective view of a pump for providing three modes of pumping according to the first embodiment of the present invention.

Referring to FIGS. 1 through 8, there is shown a pump for providing three modes of pumping according to a first embodiment of the present invention. The pump includes a base 10, two treads 13 extended from the base 10, a pressure gauge 15 installed on the base 10, a cylinder 20 installed on the base 10, a first piston 311 movable in the cylinder 20, a second piston 321 movable in the cylinder 20, a first tube 31 connected to the first piston 311, a second tube 32 connected to the second piston 321, a handle 33 connected to the tubes 31 and 32 and a control device 40 for controlling the pistons 311 and 321.

Figure 2:
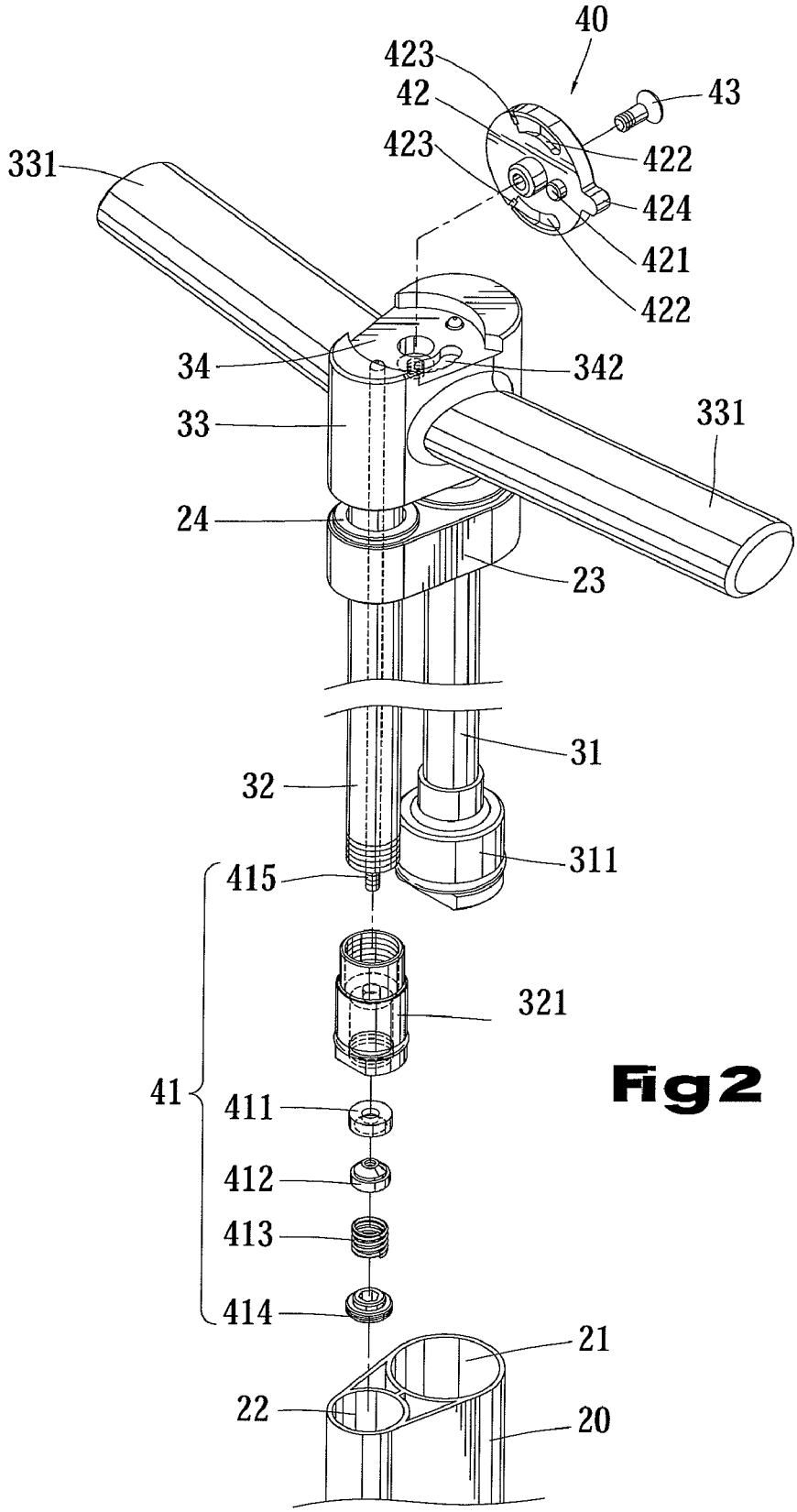
FIG. 2 is an exploded view of the pump shown in FIG. 1.
Figure 3:
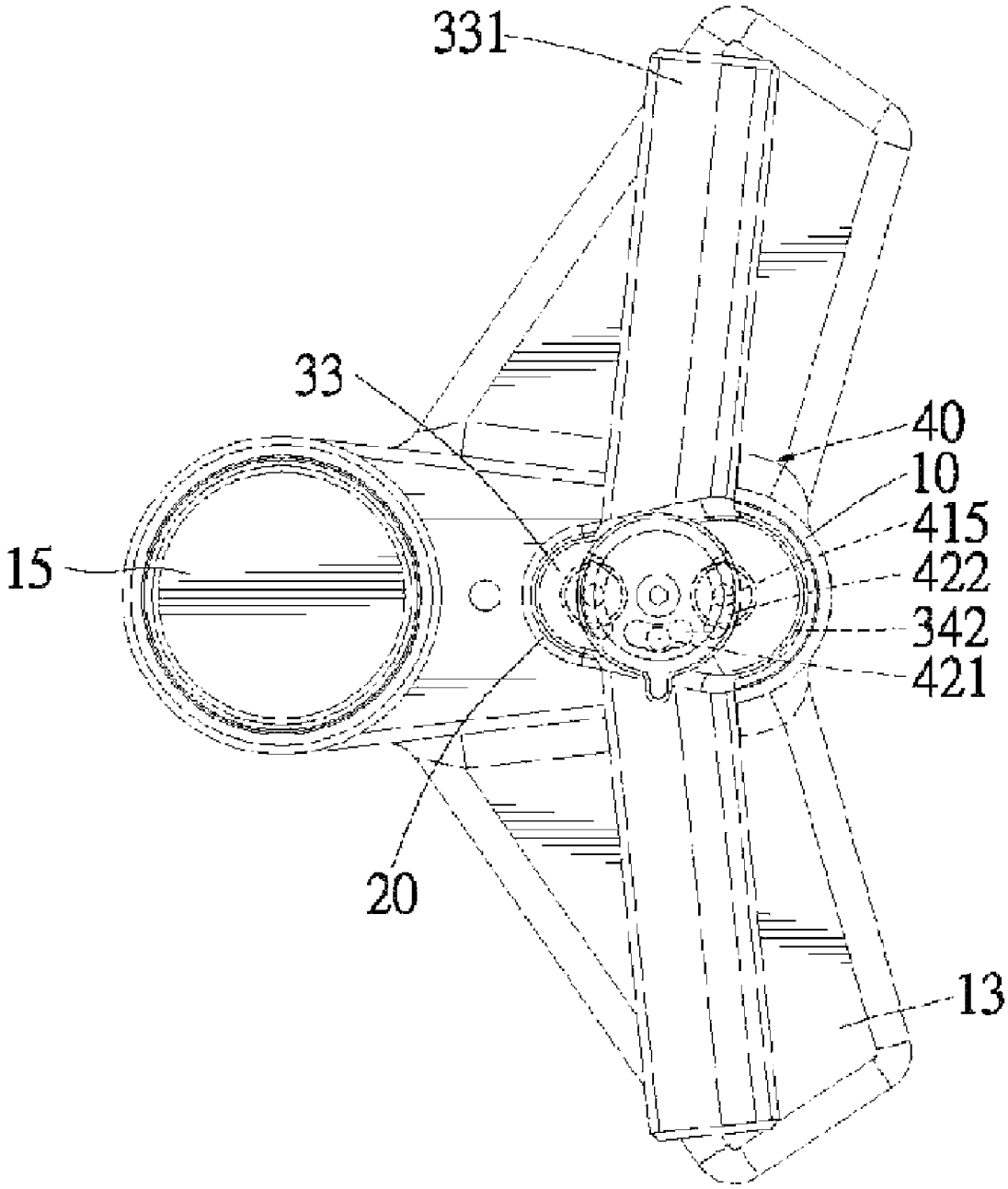
FIG. 3 is a top view of the pump shown in FIG. 1 positioned in the first mode.
Figure 4:
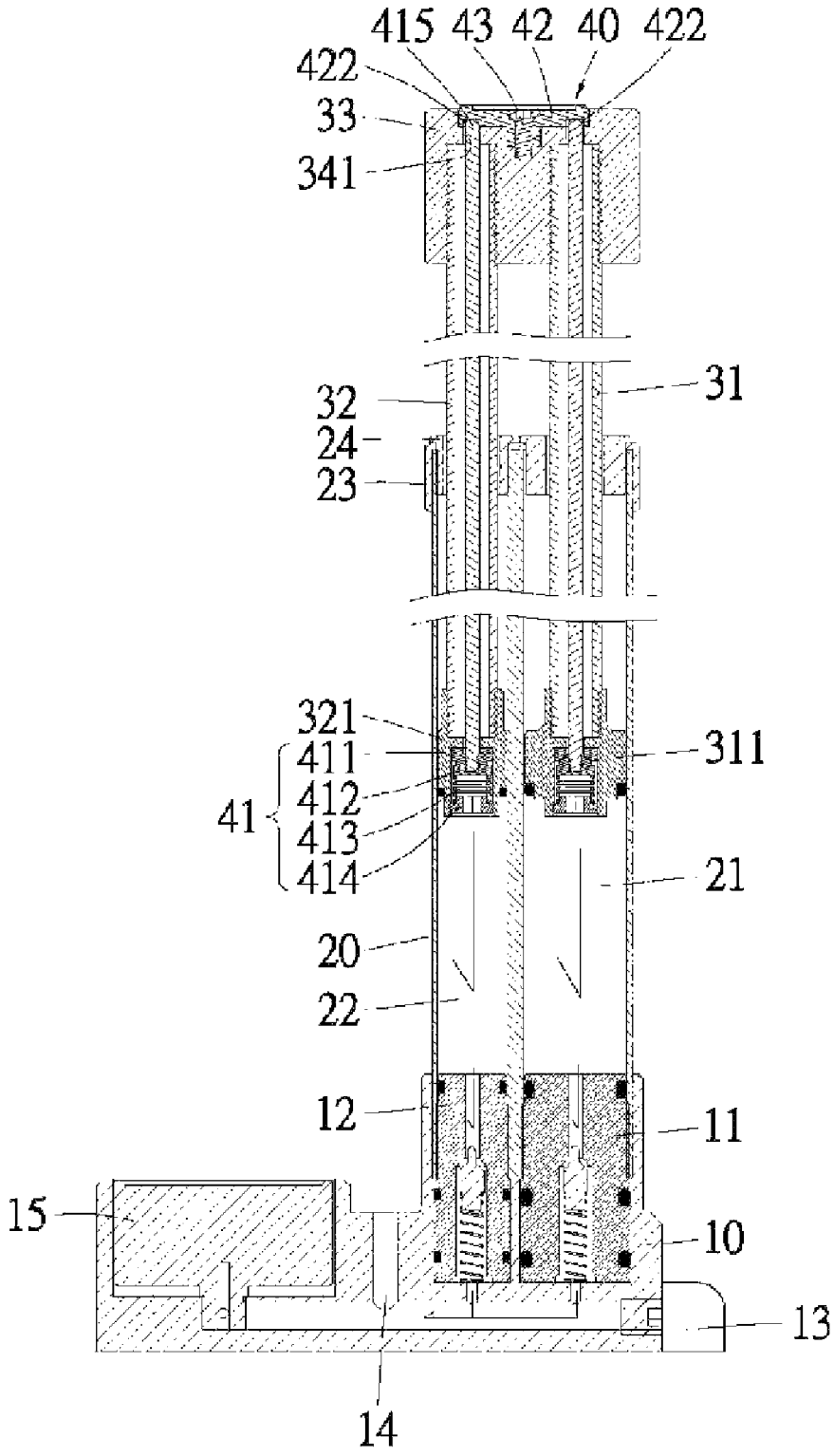
FIG. 4 is a cross-sectional view of the pump taken along a line 4-4 shown in FIG. 1.

Referring to FIGS. 2 through 4, the base 10 defines a first cavity, a second cavity and a channel 14 for communicating both of the first and second cavities with the exterior. A first check valve 11 is positioned in the first cavity. A second check valve 12 is positioned in the second cavity. The pressure gauge 15 is connected to the channel 14.

The cylinder 20 defines a first chamber 21 and a second chamber 22 not in direct communication with the first chamber 21. The diameter of the first chamber 21 is larger than that of the second chamber 22. The first chamber 21 is in communication with the first cavity of the base 10. The first check valve 11 is fit in the first chamber 21. The second check valve 12 is fit in the second chamber 22. The first piston 311 is movable in the first chamber 21. The second piston 321 is movable in the second chamber 22. A ring 24 is fit in each of the chambers 21 and 22 to retain the pistons 311 and 321 in the chambers 21 and 22. A shackle 23 is fit on the cylinder 20 to retain the rings 24 in the chambers 21 and 22.

The handle 33 includes two grips 331. The grips 331 do not extend in a straight line so that they can conveniently be operated by a user. The handle 33 defines a cavity 34, two apertures 341 in communication with the cavity 34 and a groove 342 in communication with the cavity 34.

The control device 40 includes two valve sets 41 installed on each of the pistons 311 and 321, a switch 42 operable for switch the valve sets 41 between the modes and a fastener 43 for securing the switching 42 to the handle 33.

Each of the valve sets 41 includes a ring 411 inserted in a related one of the pistons 311 and 321, a valve 412 for abutting the ring 411, an elastic spring 413 for biasing the valve 412, a disc 414 for supporting the spring 413 and a rod 415 inserted through a related one of the tubes 31 and 32 and a related one of the apertures 341. The valve 412 is attached to a lower end of the rod 415.

The switch 42 is in the form of a disc rotationally installed on the handle 33. The switch 42 includes a block 421 formed on the underside, two grooves 422 defined in the underside, two vents 423 also defined in the underside and an extension 424 formed on the periphery. The block 421 is movable in the groove 342 so as to limit the rotation of the switch 42 on the handle 33 with an appropriate range. Each of the grooves 422 includes a changing depth. That is, each of the grooves 422 includes a deep portion and a shallow portion. The grooves 422 receive the upper ends of the rods 415. The extension 424 is used to facilitate the rotation of the switch 42.

Referring to FIGS. 3 and 4, the pump is positioned in the first mode. The upper ends of the rods 415 are positioned in the deep portions of the grooves 422 so that the valves 412 are pressed on the rings 411 by the elastic elements 413. Both of the valve sets 41 are closed.

When the pistons 311 and 321 are moved toward the check valves 11 and 12, air is pumped from both of the chambers 21 and 22. Hence, the pumping is conducted at a high rate and at a first pressure.

Figure 5:
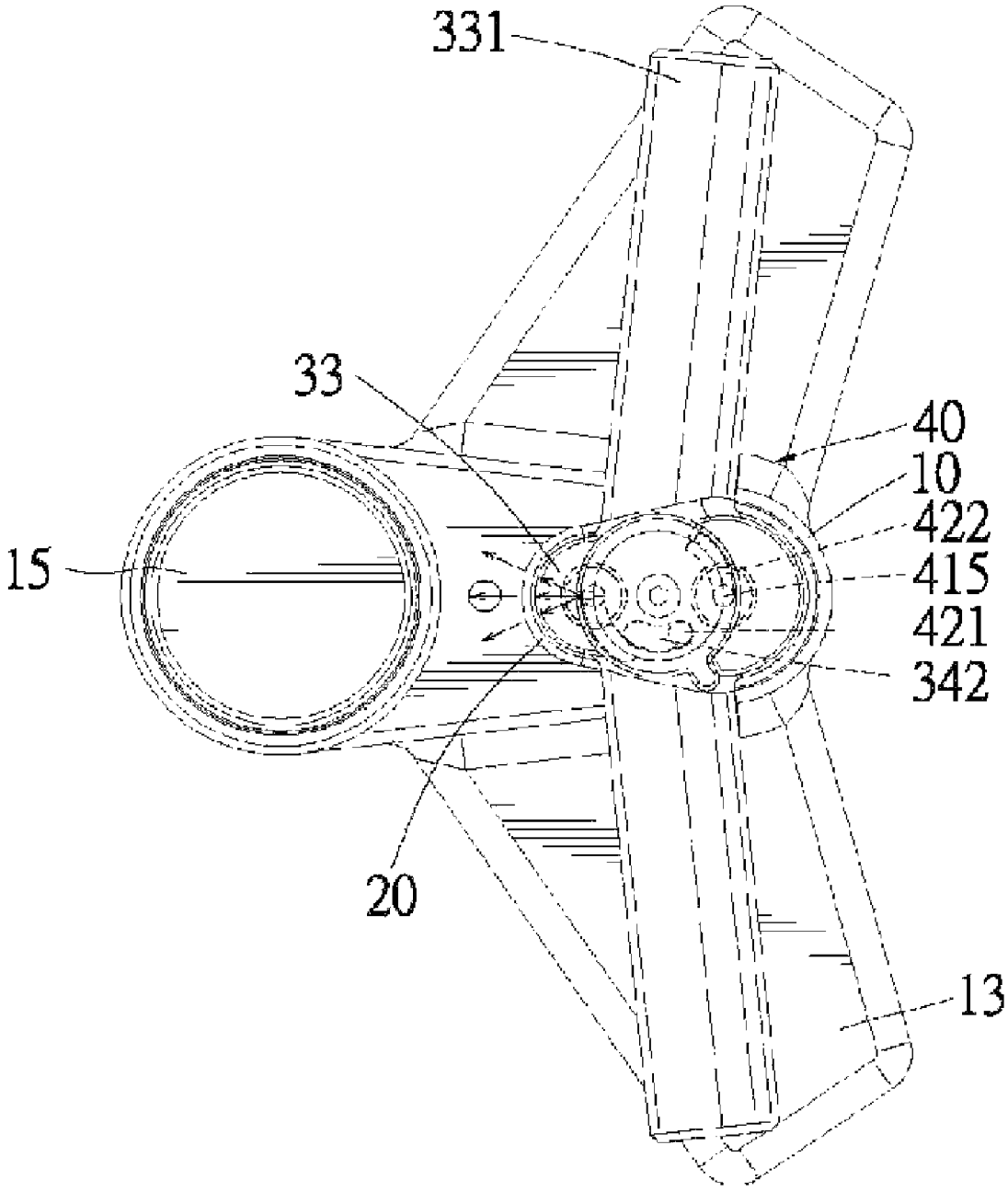
FIG. 5 is a top view of the pump shown in FIG. 1 positioned in the second mode.
Figure 6:
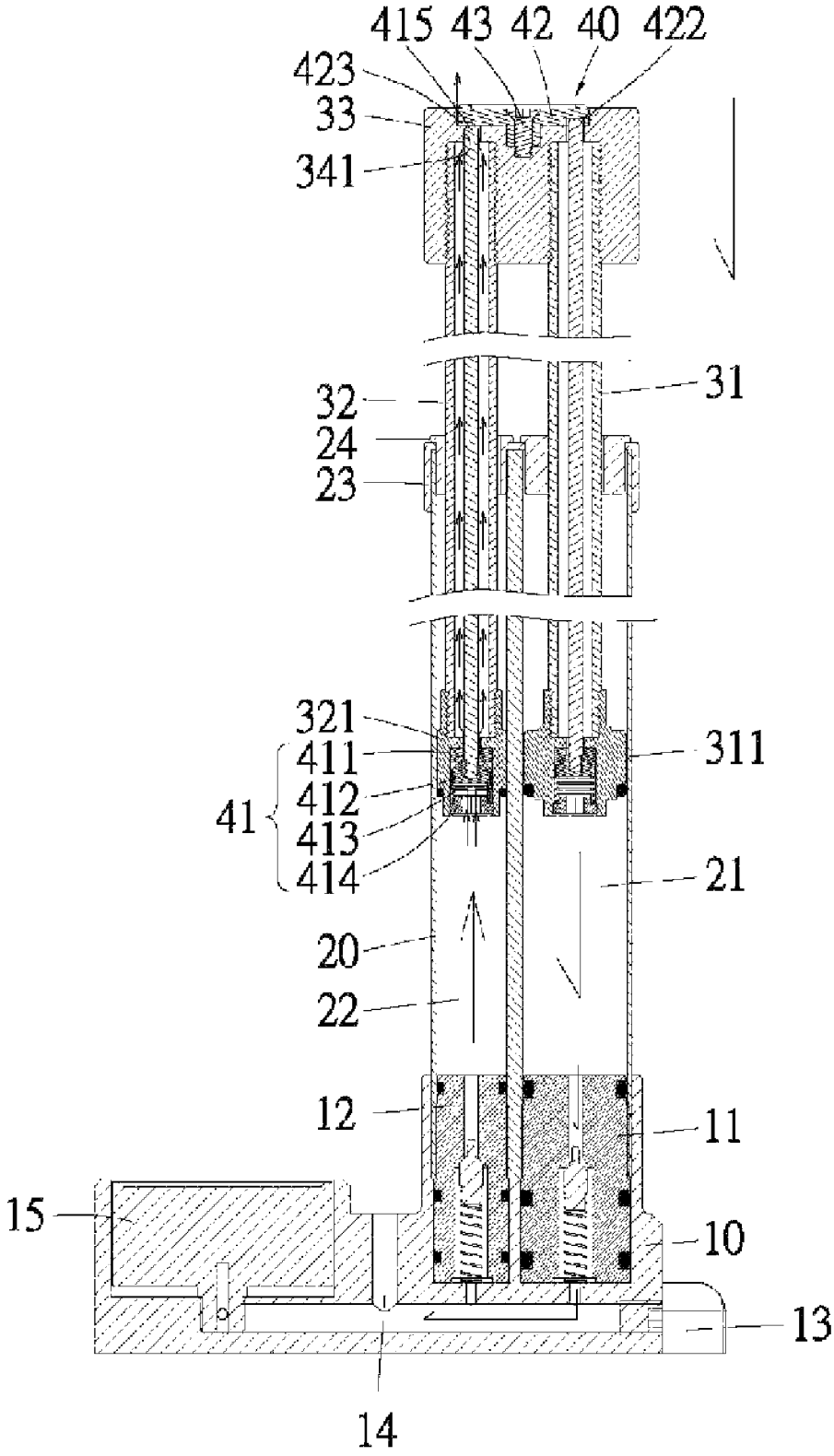
FIG. 6 is a cross-sectional view of the pump shown in FIG. 5.

Referring to FIGS. 5 and 6, the pump is positioned in the second mode. The upper end of the rod 415 exposed from the first chamber 21 is positioned in the deep portion of the related groove 422. Thus, the related valve 412 is pressed on the related ring 411 by the related elastic element 413. Closed is the valve set 41 installed on the first piston 311. The upper end of the rod 415 exposed from the second chamber 22 is positioned in the shallow portion of the related groove 422. Thus, the related valve 412 is moved from the related ring 411. Open is the valve set 41 installed on the second piston 321.

When the pistons 311 and 321 are moved toward the check valves 11 and 12, air is pumped into the channel 14 from the first chamber 21 only. Air is vented from the second chamber 22 through the valve set 41 installed on the second piston 321. Hence, the pumping is conducted at a medium rate and at a second pressure higher than the first pressure.

Figure 7:
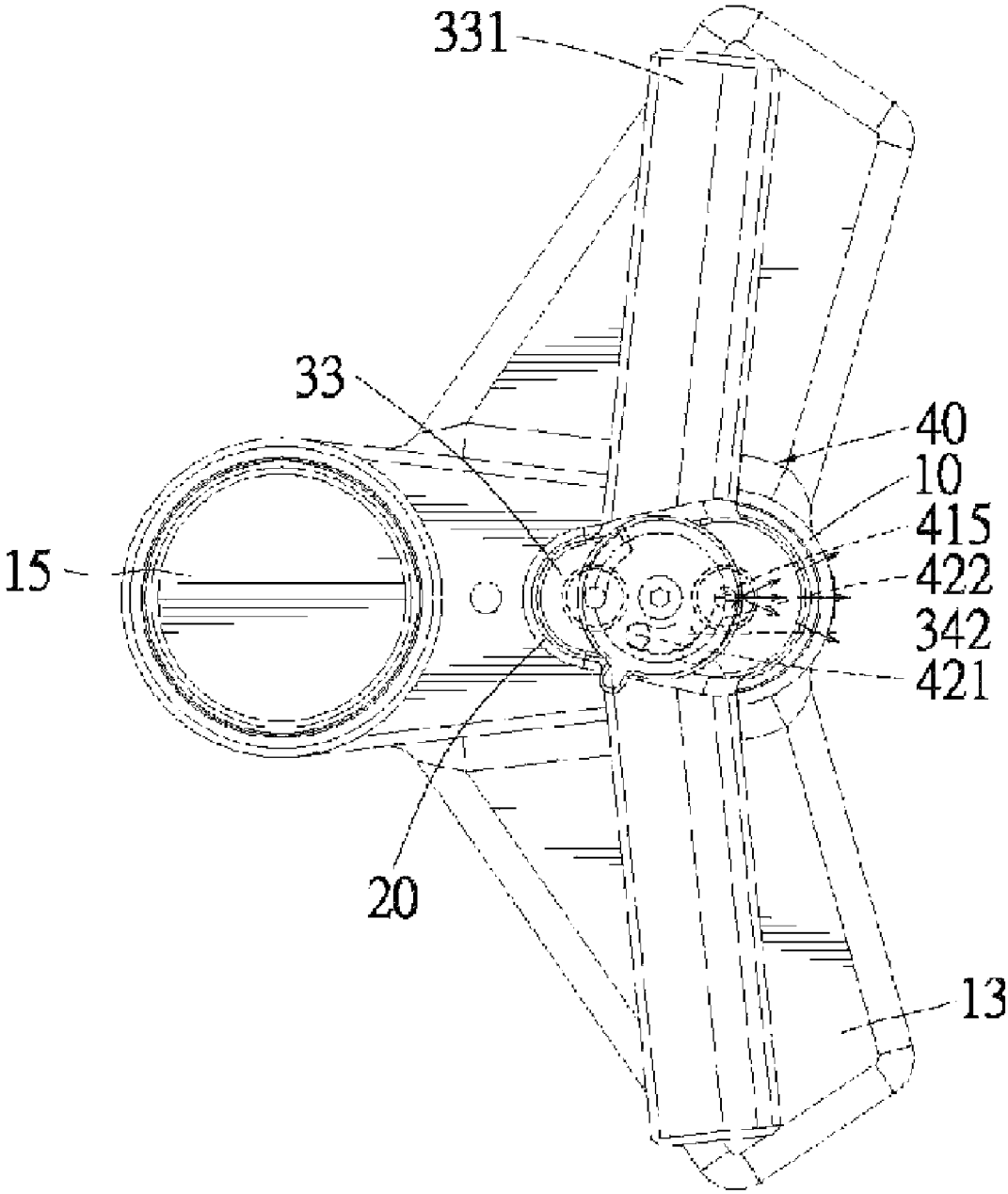
FIG. 7 is a top view of the pump shown in FIG. 1 positioned in the third mode.
Figure 8:
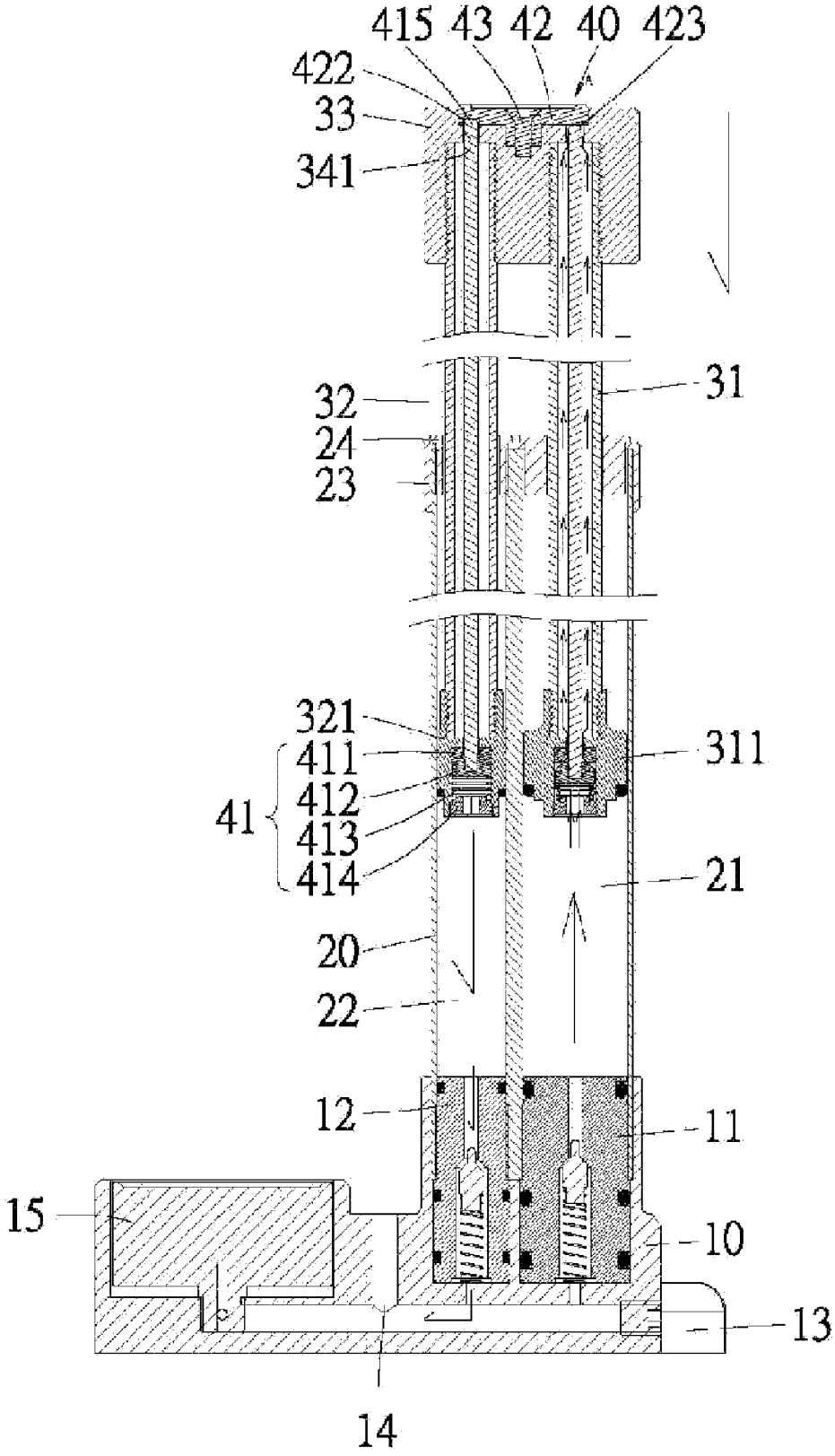
FIG. 8 is a cross-sectional view of the pump shown in FIG. 7.
Figure 9:
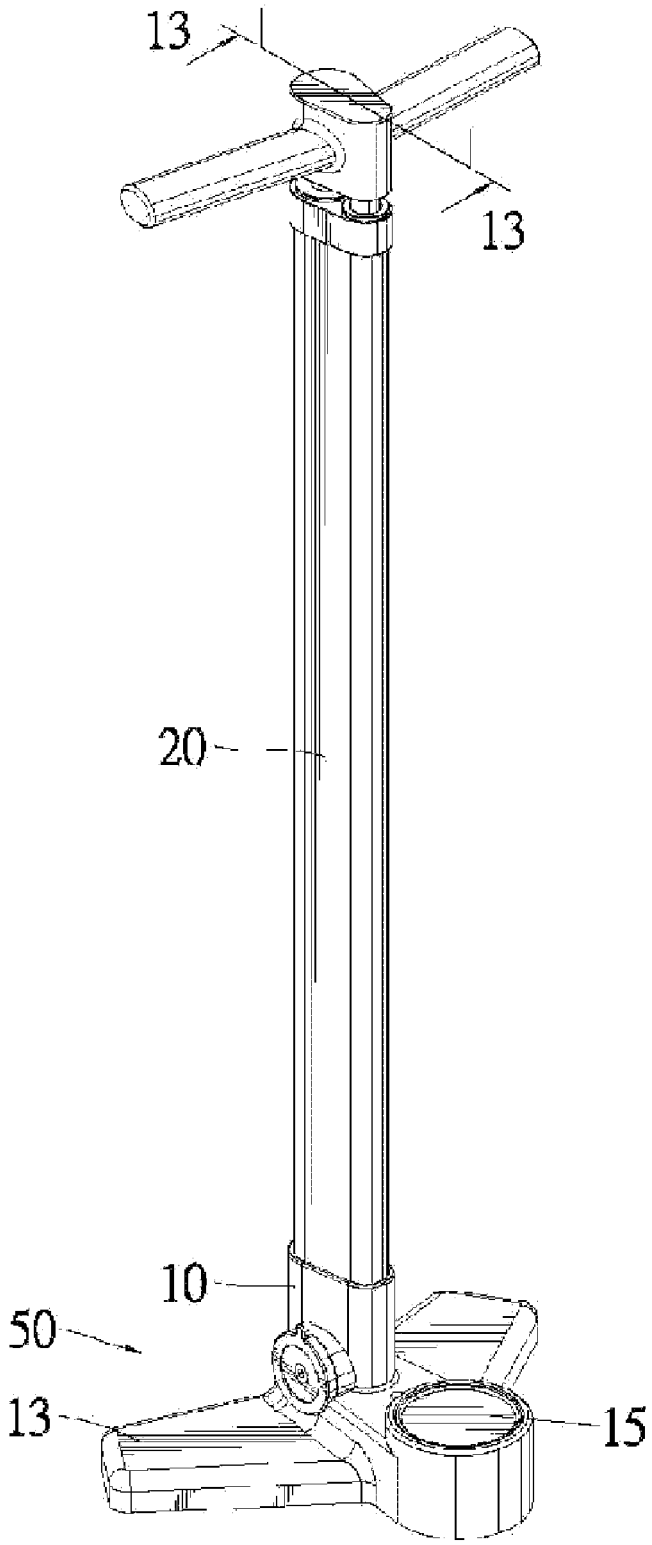
FIG. 9 is a perspective view of a pump for providing three modes of pumping according to the second embodiment of the present invention.
Figure 10:
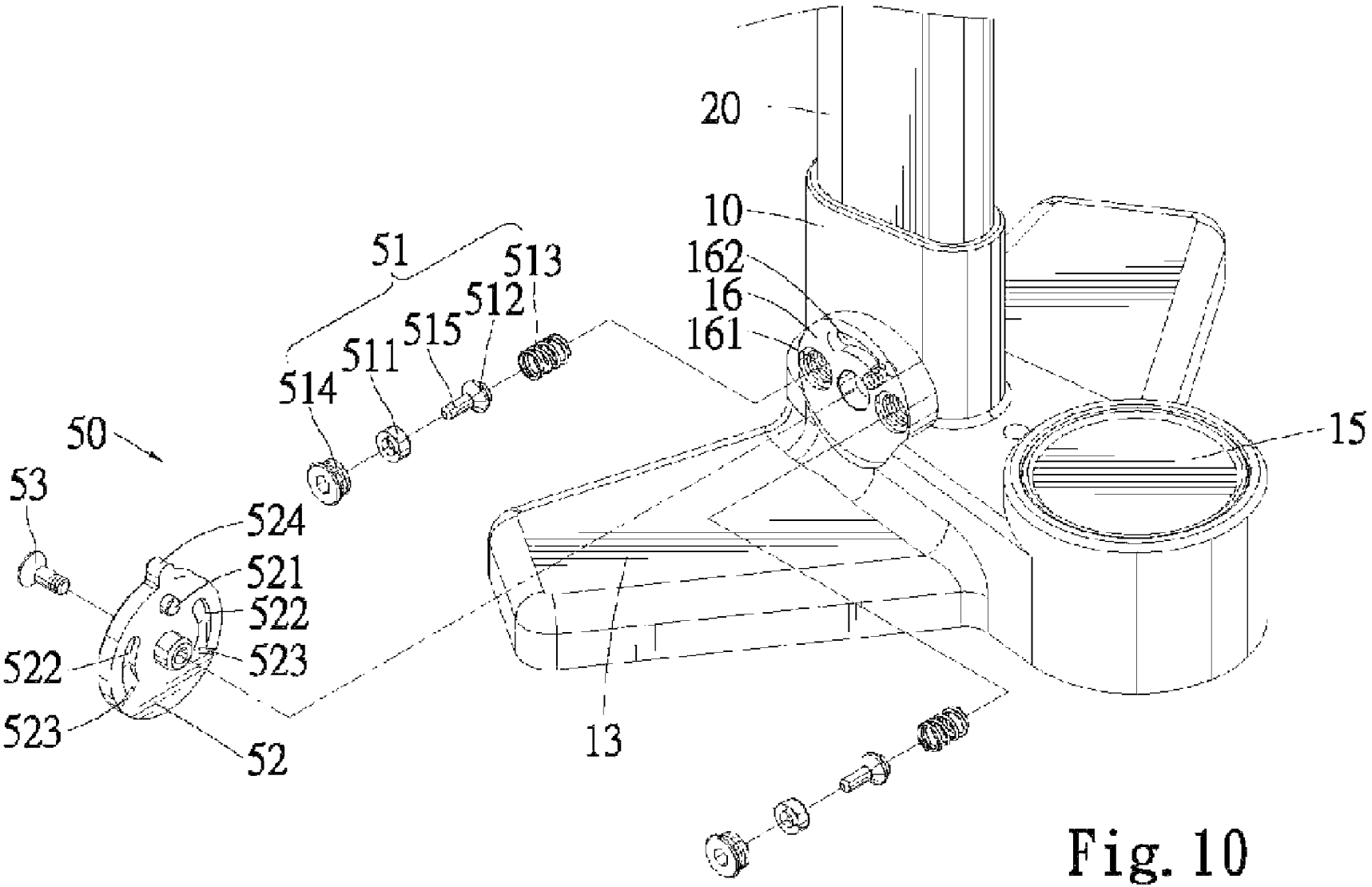
FIG. 10 is an exploded view of the pump shown in FIG. 9.

Referring to FIGS. 7 and 8, the pump is positioned in the third mode. The upper end of the rod 415 exposed from the first chamber 21 is positioned in the shallow portion of the related groove 422. Thus, the related valve 412 is moved from the related ring 411. Open is the valve set 41 installed on the first piston 311. The upper end of the rod 415 exposed from the second chamber 22 is positioned in the deep portion of the related groove 422. Thus, the related valve 412 is pressed on the related ring 411 by the related elastic element 413. Closed is the valve set 41 installed on the second piston 321.

When the pistons 311 and 321 are moved toward the check valves 11 and 12, air is pumped into the channel 14 from the second chamber 22 only. Air is vented from the first chamber 21 through the valve set 41 installed on the first piston 311. Hence, the pumping is conducted at a low rate and at a third pressure higher than the second pressure.

Referring to FIGS. 9 through 19, there is shown a pump for providing three modes of pumping according to a second embodiment of the present invention. The second embodiment is identical to the first identical embodiment except including a control device 50 instead of the control device 40. The control device 50 allows air to vent from the first chamber 21 and the second chamber 22 directly instead of through the first piston 311 and the second piston 321. Two rods can accordingly be used instead of tubes 31 and 32.

Furthermore, there is a flat wall 16 formed on the base 10 instead of the cavity 34 defined in the handle 33. The flat wall 16 defines two apertures 161 in communication with the chambers 21 and 22. The flat wall 16 further defines a groove 162 similar to the groove 342.

The control device 50 includes two valve sets 51 each positioned in a related one of the check valves 11 and 12, a switch 52 and a fastener 53 for attaching the switch 52 to the flat wall 16.

Each of the valve sets 51 includes a ring 511, a valve 512, rod 515, an elastic element 513 and an annular cover 514. The elastic element 513 is positioned in a related one of the apertures 161. The valve 512 is biased by the elastic element 513. The rod 515 is connected to or formed together with the valve 512. The rod 515 is inserted through the ring 511. The valve 512 can be abutted against the ring 511. The annular cover 514 is attached to the flat wall 16 for keeping the ring 511, valve 512 and elastic element 513 in the related aperture 161.

The switch 52 includes a block 521, two grooves 522, two vents 523 and an extension 524 similar to the block 421, grooves 422, vents 423 and extension 424, respectively.

Figure 11:
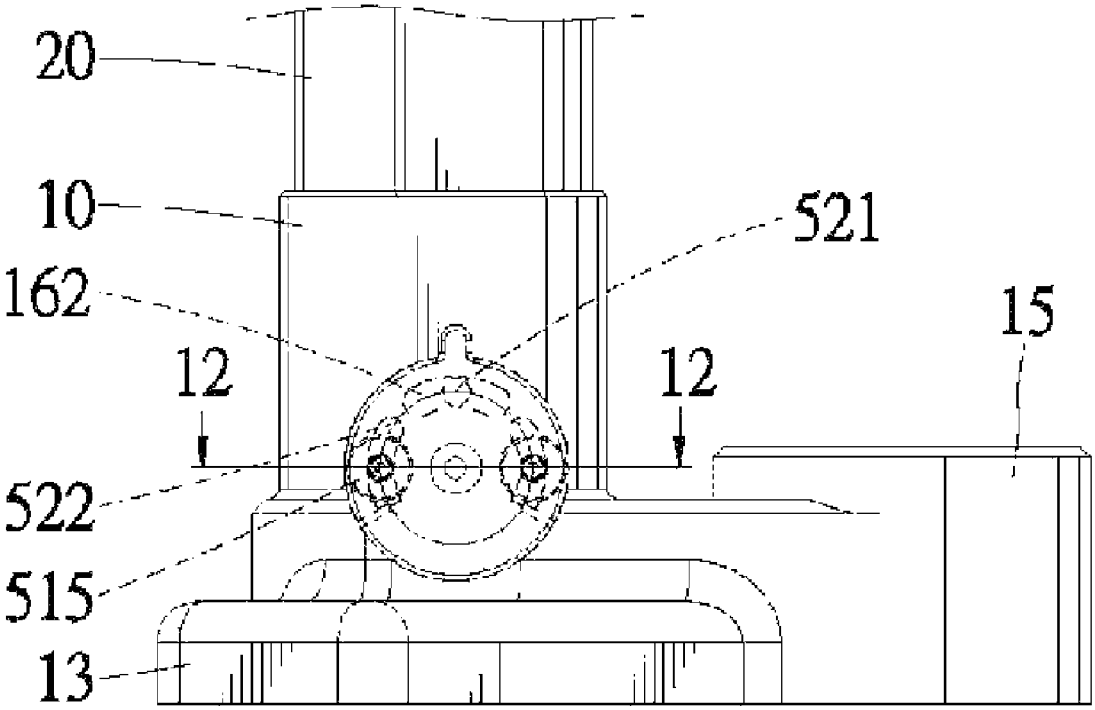
FIG. 11 is a side partial view of the pump shown in FIG. 10 positioned in the first mode.
Figure 12:
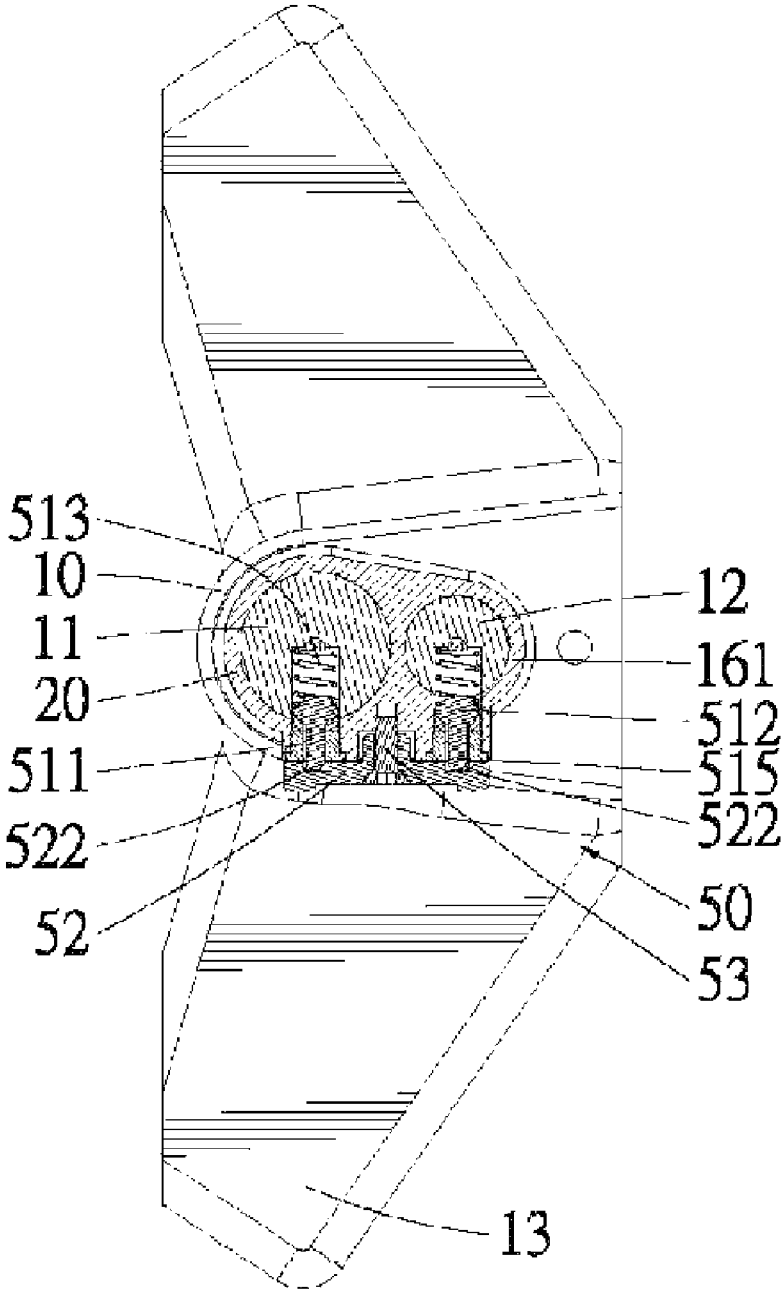
FIG. 12 is a cross-sectional view of the pump taken along a line 12-12 shown in FIG. 11.
Figure 13:
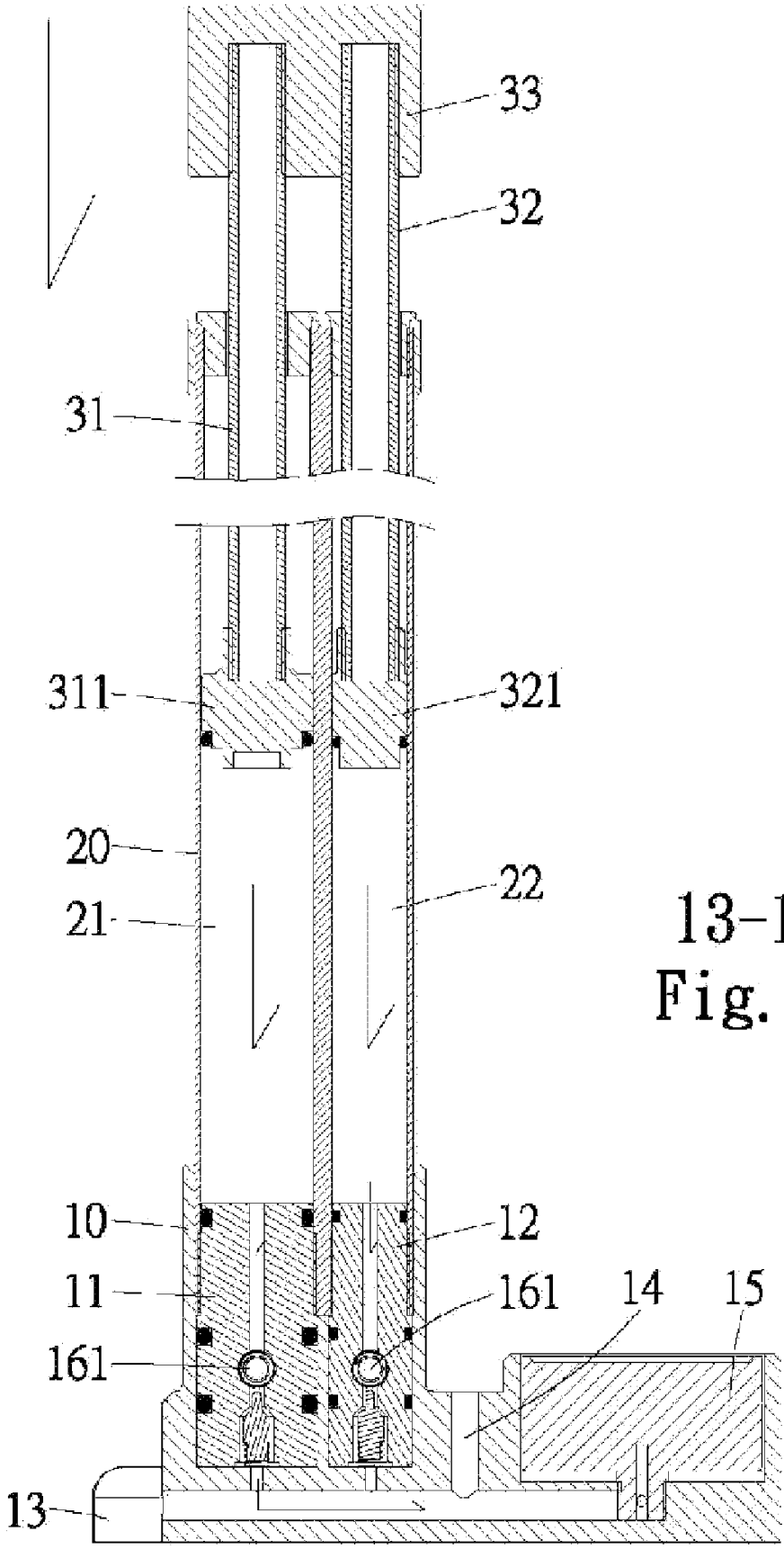
FIG. 13 is a cross-sectional view of the pump taken along a line 13-13 shown in FIG. 10.

Referring to FIGS. 11 through 13, the pump is positioned in the first mode. The ends of the rods 515 are positioned in the deep portions of the grooves 522 so that the valves 512 are pressed on the rings 511 by the elastic elements 513. Both of the valve sets 51 are closed.

When the pistons 311 and 321 are moved toward the check valves 11 and 12, air is pumped from both of the chambers 21 and 22. Hence, the pumping is conducted at a high rate and at a first pressure.

Figure 14:
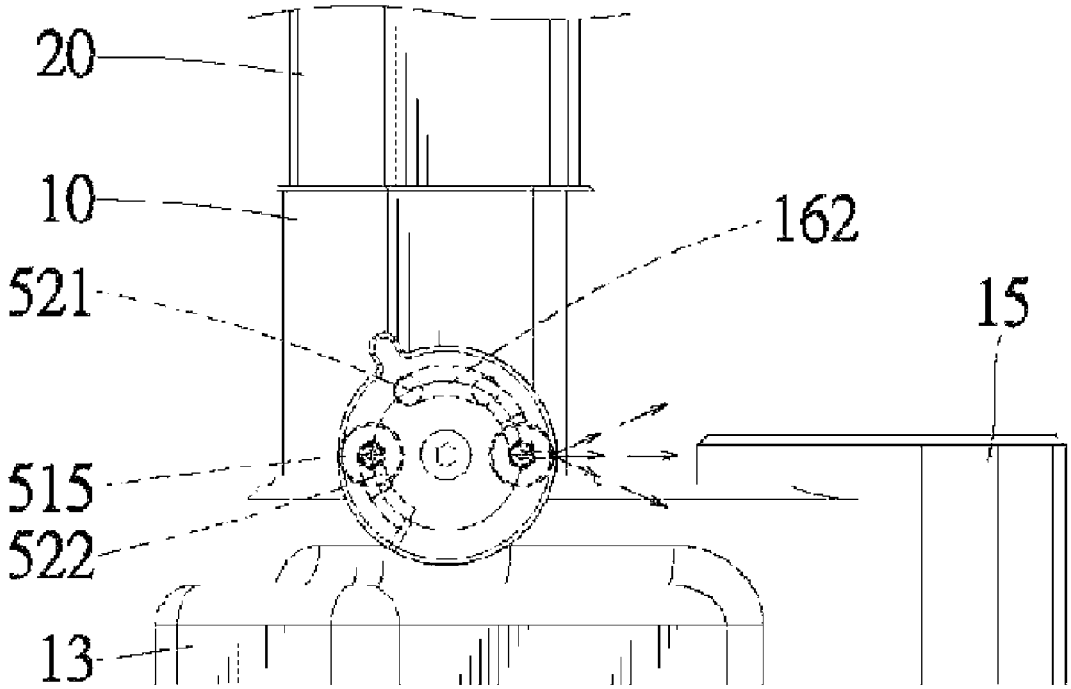
FIG. 14 is a side partial view of the pump shown in FIG. 10 positioned in the second mode.
Figure 16:
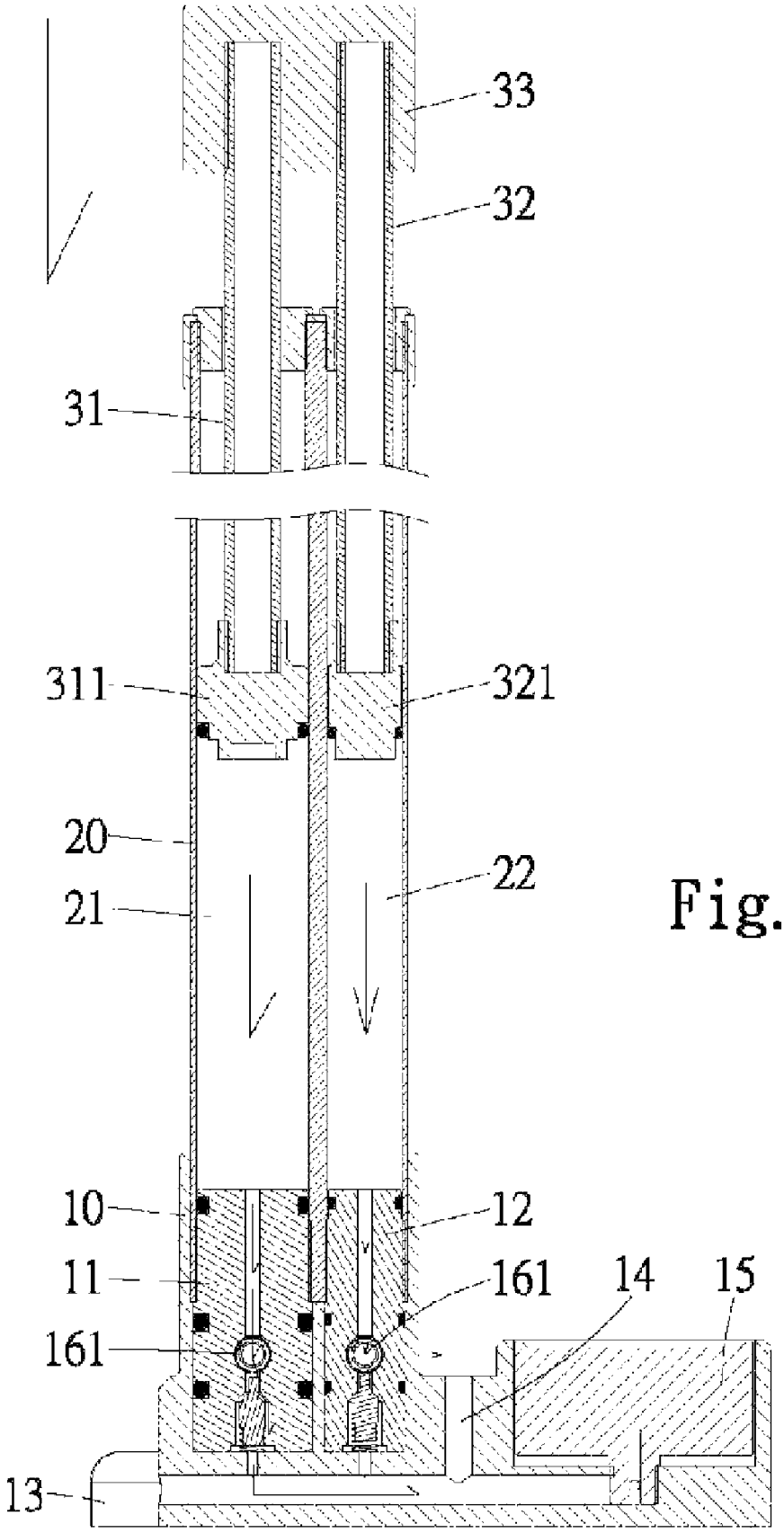
FIG. 16 is another cross-sectional view of the pump shown in FIG. 14.
Figure 17:
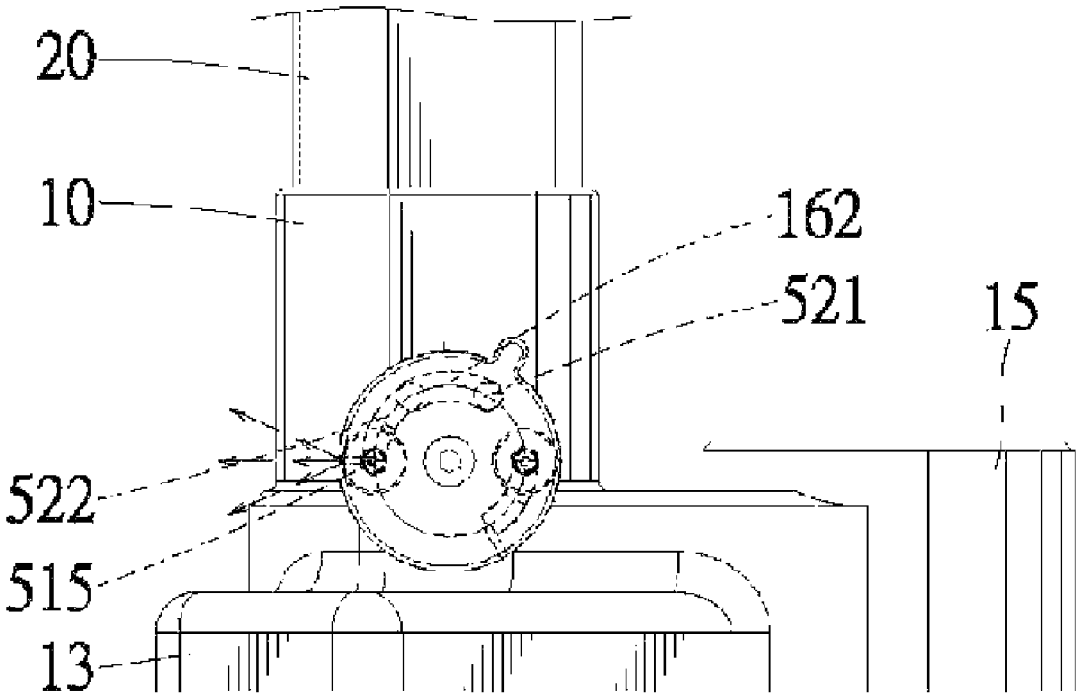
FIG. 17 is a side partial view of the pump shown in FIG. 10 positioned in the third mode.
Figure 18:
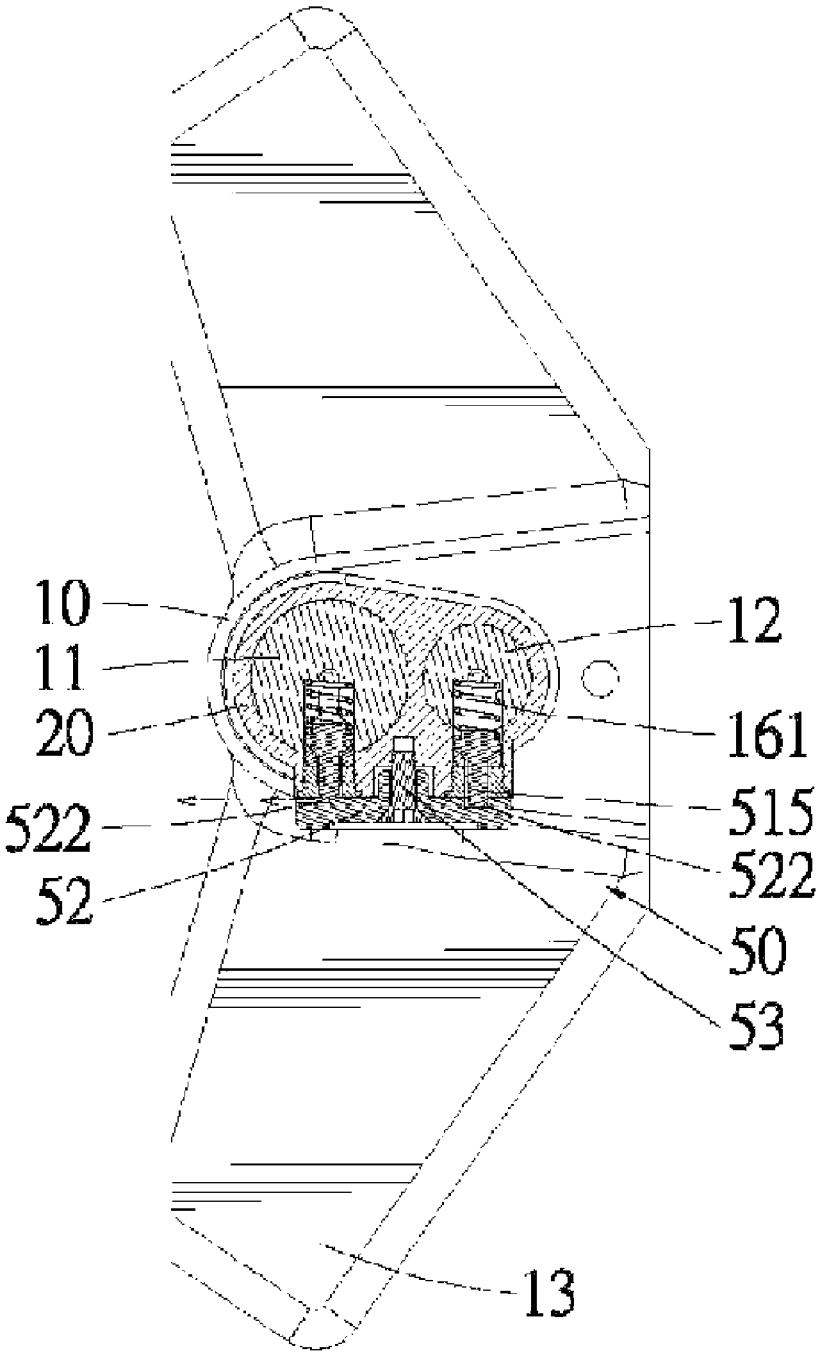
FIG. 18 is a cross-sectional view of the pump shown in FIG. 17.
Figure 19:
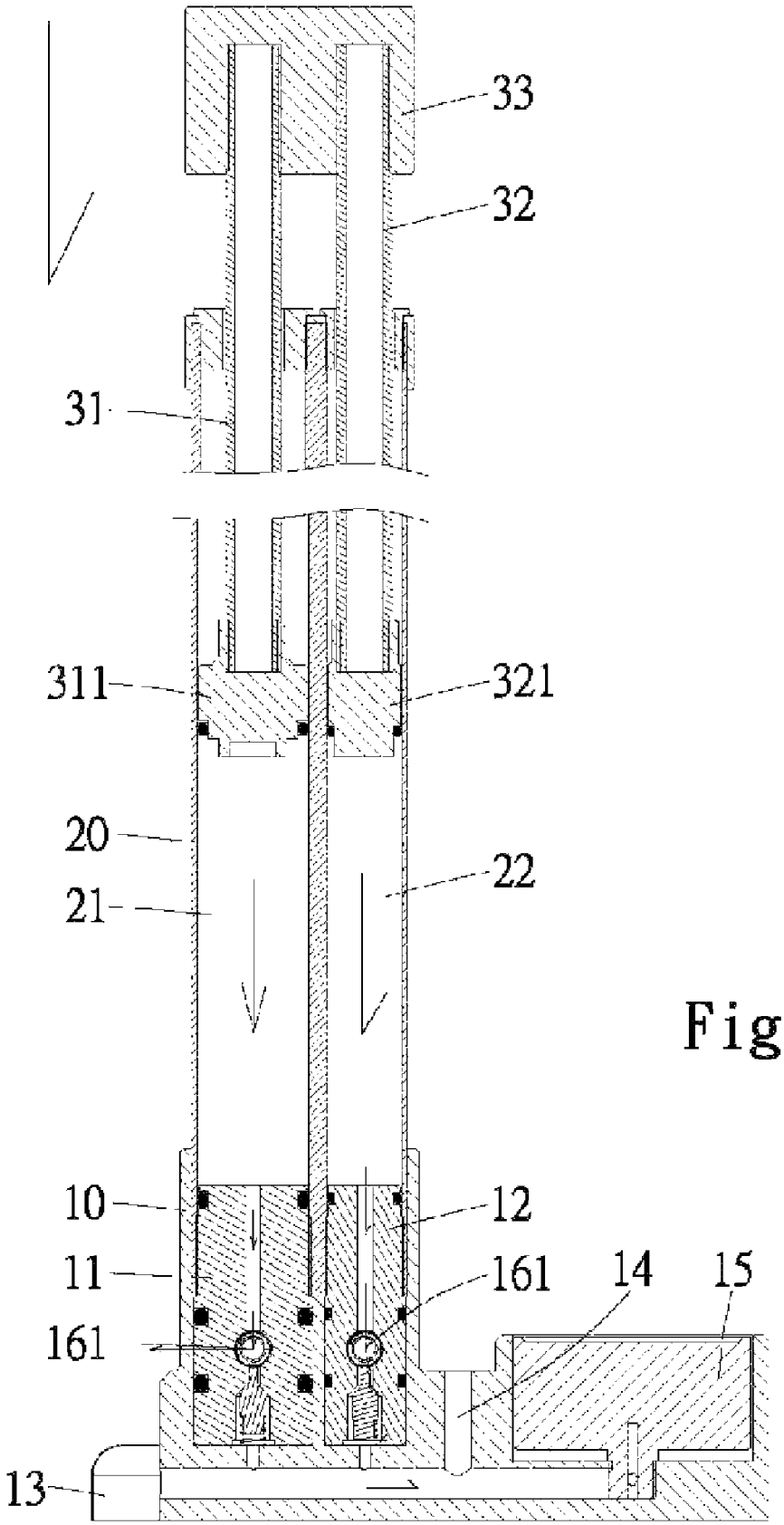
FIG. 19 is another cross-sectional view of the pump shown in FIG. 17.

Referring to FIGS. 14 and 16, the pump is positioned in the second mode. The end of the rod 515 exposed from the first chamber 21 is positioned in the deep portion of the related groove 522. Thus, the related valve 512 is pressed on the related ring 511 by the related elastic element 513. Closed is the valve set 51 for the first chamber 21. The end of the rod 515 exposed from the second chamber 22 is positioned in the shallow portion of the related groove 522. Thus, the related valve 512 is moved from the related ring 511. Open is the valve set 51 for the second chamber 22.

When the pistons 311 and 321 are moved toward the check valves 11 and 12, air is pumped into the channel 14 from the first chamber 21 only. Air is vented from the second chamber 22 through the related valve set 51. Hence, the pumping is conducted at a medium rate and at a second pressure higher than the first pressure.

Figure 15:
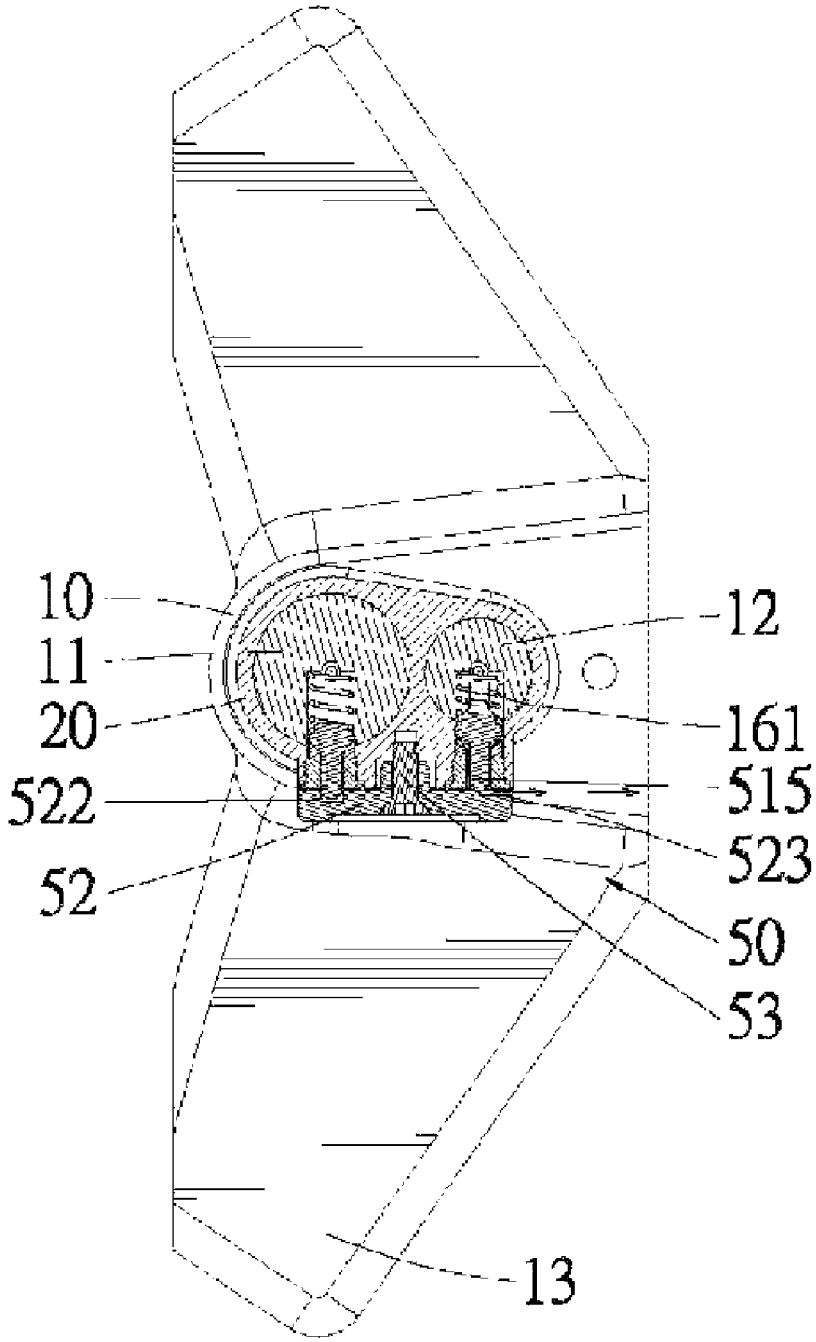
FIG. 15 is a cross-sectional view of the pump shown in FIG. 14.

Referring to FIGS. 14 through 16, the pump is positioned in the third mode. The end of the rod 515 exposed from the first chamber 21 is positioned in the shallow portion of the related groove 522. Thus, the related valve 512 is moved from the related ring 511. Open is the valve set 51 for the first chamber 21. The end of the rod 515 exposed from the second chamber 22 is positioned in the deep portion of the related groove 522 so that the related valve 512 is pressed on the related ring 511 by the related elastic element 513. Closed is the valve set 51 for the second chamber 22.

When the pistons 311 and 321 are moved toward the check valves 11 and 12, air is pumped into the channel 14 from the second chamber 22 only. Air is vented from the first chamber 21 through the valve set 51 for the first chamber 21. Hence, the pumping is conducted at a low rate and at a third pressure higher than the second pressure.

The pump of the present invention exhibits at least two advantages. Firstly, it provides three modes for pumping various tires and cushions. Secondly, its assembly is easy and, hence, inexpensive. Thirdly, it is not vulnerable to leaks. Fourthly, it provides convenience in operation for providing the grips and the treads.

The present invention has been described through the illustration of the embodiments. Those skilled in the art can derive variations from the embodiments without departing from the scope of the present invention. Therefore, the embodiments shall not limit the scope of the present invention defined in the claims.

What is claimed is:

1. A pump comprising:

a base defining a pumping channel;

a cylinder installed on the base, the cylinder defining a first chamber and a second chamber with a diameter different from that of the first chamber, wherein the first and second chambers are in communication with the pumping channel;

a first piston movable in the first chamber;

a second piston movable in the second chamber;

a first tube connected to the first piston;

a second tube connected to the second piston;

a handle connected to the first and second tubes; and a control device installed on the handle for allowing air to travel from the first and second chambers through the pumping channel in a first mode, venting air from the second chamber through the second piston and the second tube in a second mode, and venting air from the first chamber through the first piston and the first tube in a third mode, wherein the control device comprises a first valve set installed on the first piston and a second valve set installed on the second piston, wherein each of the valve sets comprises a rod inserted through a related one of the tubes, wherein the control device comprises a switch rotatably mounted to the handle about a switch axis, with the switch controlling the valve sets through the rods;

wherein the switch of the control device includes two grooves defined therein, with each of the two grooves including a deep portion and a shallow portion, and with the two grooves receiving upper ends of the rods, with each of the two grooves being concentric to the switch axis and spaced from each other;

with the control device positioned in the first mode, the upper ends of the rods are positioned in the deep portions of the two grooves so that both of the first and second valve sets are closed and air is pumped from both of the first and second chambers;

with the control device positioned in the second mode, the upper end of the rod exposed from the first chamber is positioned in the deep portion of the related groove so that the first valve set is closed and the upper end of the rod exposed from the second chamber is positioned in the shallow portion of the related groove so that the second valve set is open and air is pumped into the channel from the first chamber only and is vented from the second chamber through the second valve set;

with the control device positioned in the third mode, the upper end of the rod exposed from the first chamber is positioned in the shallow portion of the related groove so that the first valve set is open and the upper end of the rod exposed from the second chamber is positioned in the deep portion of the related groove so that the second valve set is closed and air is pumped into the channel from the second chamber only and is vented from the first chamber through the first valve set.

2. The pump according to claim 1 wherein each of the valve sets comprises a ring, a valve for abutting the ring and an elastic element for biasing the valve.

3. The pump according to claim 2 wherein each of the valve sets comprises a disc attached to a related one of the pistons to support the elastic element.

4. The pump according to claim 2 wherein the rod of each of the valve sets is connected to the valve.

5. The pump according to claim 4 wherein the switch is in the form of a disc rotationally installed on the handle, with the rod of each of the valve sets engaging the disc, with the elastic element of each of the valve sets biasing the rod toward the disc.

6. The pump according to claim 5 wherein the two grooves are formed in the disc.

7. The pump according to claim 6 wherein the switch comprises two vents extending through the disc and in communication with the two grooves.

8. A pump comprising:

a base defining a pumping channel, a first aperture and a second aperture;

a cylinder installed on the base, the cylinder defining a first chamber and a second chamber with a diameter different from that of the first chamber, wherein the first chamber is in communication with the pumping channel on one hand and in communication with the first aperture on the other hand, wherein the second chamber is in communication with the pumping channel on one hand and in communication with the second aperture on the other hand;

a first piston movable in the first chamber;

a second piston movable in the second chamber; and a control device installed on the base for allowing air to travel from the first and second chambers through the pumping channel in a first mode, venting air from the second chamber of the cylinder through the second aperture of the base in a second mode, and venting air from the first chamber of the cylinder through the first aperture of the base in a third mode, wherein the control device comprises a first valve set positioned in the first aperture of the base and a second valve set positioned in the second aperture of the base, wherein each of the valve sets comprises a rod exposed from a related one of the chambers, wherein the control device comprises a switch rotatably mounted to the base about a switch axis, with the switch controlling the valve sets through the rods;

wherein the switch of the control device includes two grooves defined therein, with each of the two grooves including a deep portion and a shallow portion, and with the two grooves receiving upper ends of the rods, with each of the two grooves being concentric to the switch axis and spaced from each other;

with the control device positioned in the first mode, the upper ends of the rods are positioned in the deep portions of the grooves so that both of the first and second valve sets are closed and air is pumped from both of the first and second chambers;

with the control device positioned in the second mode, the upper end of the rod exposed from the first chamber is positioned in the deep portion of the related groove so that the first valve set is closed and the upper end of the rod exposed from the second chamber is positioned in the shallow portion of the related groove so that the second valve set is open and air is pumped into the channel from the first chamber only and is vented from the second chamber through the second valve set;

with the control device positioned in the third mode, the upper end of the rod exposed from the first chamber is positioned in the shallow portion of the related groove so that the first valve set is open and the upper end of the rod exposed from the second chamber is positioned in the deep portion of the related groove so that the second valve set is closed and air is pumped into the channel from the second chamber only and is vented from the first chamber through the first valve set.

9. The pump according to claim 8 wherein each of the valve sets further comprises a ring, a valve for abutting the ring, an elastic element for biasing the valve and an annular cover attached to the cylinder to support the elastic element.

10. The pump according to claim 9 wherein the rod of each of the valve sets is connected to the valve.

11. The pump according to claim 10 wherein the switch is in the form of a disc rotationally installed on the base, with the rod of each of the valve sets engaging the disc, with the elastic element of each of the valve sets biasing the rod toward the disc.

12. The pump according to claim 11 wherein the two grooves are formed in the disc.

13. The pump according to claim 12 wherein the switch comprises two vents extending through the disc and in communication with the two grooves.

14. The pump according to claim 8 wherein the switch comprises an extension extended from a periphery thereof.

* * * * *